US006374786B1

(12) United States Patent
Ogawa

(10) Patent No.: US 6,374,786 B1
(45) Date of Patent: Apr. 23, 2002

(54) VALVE TIMING CONTROLLER

(75) Inventor: Kazumi Ogawa, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/667,213

(22) Filed: Sep. 21, 2000

(30) Foreign Application Priority Data

Sep. 24, 1999 (JP) ..... 11-270590

(51) Int. Cl.[7] ..... F01L 1/344

(52) U.S. Cl. ..... 123/90.17; 74/568 R; 464/2; 464/160

(58) Field of Search ..... 123/90.15, 90.17, 123/90.31; 74/568 R; 464/1, 2, 60

(56) References Cited

U.S. PATENT DOCUMENTS

| | | | | |
|---|---|---|---|---|
| 4,858,572 A | | 8/1989 | Shirai et al. | 123/90.12 |
| 6,053,139 A | * | 4/2000 | Eguchi et al. | 123/90.17 |
| 6,058,897 A | * | 5/2000 | Nakayoshi | 123/90.17 |
| 6,079,382 A | | 6/2000 | Schafer et al. | 123/90.17 |

FOREIGN PATENT DOCUMENTS

| | | |
|---|---|---|
| DE | 19755495 A1 | 6/1999 |
| JP | 9-60508 | 3/1997 |
| JP | 9-209723 | 8/1997 |

* cited by examiner

*Primary Examiner*—Wellun Lo
(74) *Attorney, Agent, or Firm*—Reed Smith LLP

(57) ABSTRACT

A valve timing controller with the structure of a stopper mechanism and a lock mechanism thereof is so provided as to reduce the cost and the size of the controller. The valve timing controller comprises a stopper mechanism and a lock mechanism including a lock member assembled with a housing member and a tip portion of the lock member which is always projecting towards a rotor member, a free recess portion formed on the rotor member and accommodating the tip portion of the lock member while allowing the relative rotation of the housing member and the rotor member, a stopper surface formed on one end surface in circumferential direction of the free recess portion and defining a initial phase by the contact with the tip portion of the lock member, a lock recess portion formed continuously along the stopper surface and being capable of accommodating the tip portion of the lock member by restricting the movement thereof in circumferential direction at an initial phase, and a lock spring biasing the lock member towards the lock recess portion.

3 Claims, 5 Drawing Sheets

VALVE TIMING CONTROLLER

BACKGROUND OF THE INVENTION

1. Field of the Invention

This invention relates to a valve timing controller and, more particularly, to a valve timing controller for controlling the valve timing of an intake valve and an exhaust valve for a valve train of an internal combustion engine.

2. Description of the Related Arts

A prior art of the valve timing controller of this kind is disclosed in Japan Patent Laid-open Publication H09-60508 (published on Mar. 4, 1997). In this prior art, the valve timing controller is disposed in the driving force transmitting system transmitting the driving force from the drive shaft of an internal combustion engine (a crankshaft of the engine) to the driven shaft (camshaft) opening and closing either an intake valve or an exhaust valve of the internal combustion engine. The valve timing controller in this prior art comprises a housing member rotating in one unit with the drive shaft (or the driven shaft), a rotor member assembled at a pair of shoe portions provided in the housing member for relative rotation therewith at a hub portion, forming an advance angle fluid chamber and a retard angle fluid chamber at a vane portion, and rotating in one unit with the driven shaft (or the drive shaft), a stopper mechanism defining the initial phase of the housing member and the rotor member, a lock mechanism defining the relative rotation of the housing member and the rotor member at the initial phase, and a hydraulic pressure circuit controlling the supply and exhaust of the operation fluid to the advance angle fluid chamber and the retard angle fluid chamber and controlling the lock/unlock of the lock mechanism.

In the valve timing controller of above mentioned prior art, a stopper mechanism is adopted which includes a stopper surface provided on the circumferential direction end of the shoe portion (the portion rotatably supporting the rotor member) of the housing member and a contacting surface provided on the circumferential direction end of the vane portion (the portion forming the advance angle fluid chamber and the retard angle fluid chamber with the shoe portion) of the rotor member. The initial phase of the housing member and the rotor member is defined by the contact between the stopper surface and the contacting surface.

The lock mechanism of above-mentioned prior art comprises a piston assembled slidably in axial direction of the camshaft in an accommodation hole disposed in the vane portion of the rotor member and having a tip end tapered off, a tapered hole disposed in the housing member and being capable of tapered fitting with the tip portion of the piston at the initial phase of the housing member and the rotor member, and a spring biasing the piston towards the tapered hole. By tapered fitting of the tip of the piston and the tapered hole at the initial phase of the housing member and the rotor member, the relative rotation between the housing member and the rotor member is restricted and the relative rotation between the housing member and the rotor member is allowed under the condition that the tip portion of the piston is separated or retrieved from the tapered hole.

However, the valve timing controller of the prior art has the following disadvantages: Since the contacting surface (the end surface in circumferential direction) provided on the vane portion of the rotor member contacts the stopper surface (the end surface in circumferential direction) provided on the shoe portion of the housing member, high precision machining is required on the end surface in circumferential direction of the shoe portion of the housing member and on the end surface in circumferential direction of the vane portion of the rotor member. The vane portion of the rotor member and the shoe portion of the housing member are required to have enough strength to bear against the load at contacting.

Having the initial phase of the housing member and the rotor member as a standard, that is, for the manufacturing precision of the stopper surface formed on the shoe portion of the housing member and of the contacting surface formed on the vane portion of the rotor member, severe tolerance of the relative position between the tip portion of the piston and the tapered hole is required (Since the piston is a separated member from the member formed with the contacting surface and the stopper surface and the tapered fitting portion is provided at the different location from the contacting portion of the stopper surface and the contacting portion, it is very difficult to satisfy the highly required precision). Since the relative rotation of the housing member and the rotor member is allowed when the tip portion of the piston is separated or retrieved from the tapered hole, in the case the external materials entered into the tip portion of the piston which has been separated from the tapered hole (since the tip portion of the piston is tapered off, a large gap is generated between the piston and the accommodation hole, and the external materials is easy to be entered), such external materials tend to be trapped between the tip portion of the piston (tapered tip end portion) and the accommodation hole.

SUMMARY OF THE INVENTION

Accordingly, an object of the valve timing controller of the invention is to reduce the size, improve the productivity and achieve reliable operation.

To solve the aforementioned problems the following technical means is provided with a valve timing of the invention provided on the driving force transmitting system transmitting the driving force to the driven shaft opening and closing either intake valve or an exhaust valve of an internal combustion from the drive shaft of the internal combustion engine, a housing member rotatable in one unit with the drive shaft (or the driven shaft), a rotor member rotatably assembled with a pair of shoe portions provided on the housing member, forming an advance angle fluid chamber and a retard angle fluid chamber at a vane portion, and rotating in one unit with the driven shaft (or the drive shaft), a stopper mechanism defining the initial phase of the housing member and the rotor member, a lock mechanism restricting the relative rotation of the housing member and the rotor member at the initial phase, and a hydraulic pressure circuit controlling the supply and exhaust of the operation fluid to the advance angle fluid chamber and the retard angle fluid chamber and controlling the lock/unlock of the lock mechanism. The stopper mechanism and the lock mechanism include a lock member slidably assembled with the housing member (or the rotor member) and the tip portion of the lock member which is always projecting towards the rotor member (or the housing member), a free recess portion formed in the rotor member (or the housing member) and accommodating the tip portion of the lock member while allowing the relative rotation of the housing member and the rotor member, a stopper surface formed on the end surface in circumferential direction of the free recess portion and defining the initial phase by the contact with the tip portion of the lock member, a lock recess portion formed continuously along the stopper surface and being capable of accommodating the tip portion of the lock member with restricting the movement thereof in circumferential direction at the initial phase, and a lock spring biasing the lock member towards the lock recess portion.

In this case, it is desirable to form a second stopper surface limiting the maximum relative rotation of the rotor member relative to the housing member on the other end surface in the circumferential of the free recess portion opposite to the stopper surface.

The valve timing of the invention includes a first rotation body opening and closing either the intake valve or the exhaust valve of the internal combustion engine, a second rotation body rotating in one unit with the drive shaft of the internal combustion engine and transmitting the driving force from the drive shaft to the first rotation body, a phase change controlling means changing the phase of the first rotation body either to the advance angle side or to the retard angle side relative to the second rotation body, and a restricting means including a stopper mechanism regulating the rotational amount of the first rotation body relative to the second rotation body at least to either side of the advance angle side and the retard angle side and a lock mechanism restricting the relative rotation of the first rotation body and the second rotation body. The stopper mechanism and the lock mechanism of the restricting means are formed in one unit.

In this case, the first rotation body and the second rotation body are coaxially arranged. It is desirable that the restricting means is comprised of a lock member rotatably and slidably disposed on one of the first rotation body and the second rotation body, the free recess portion provided on the other of the first rotation body and the second rotation body and accommodating the lock member while allowing the relative rotation of the first rotation body and the second rotation body, the stopper surface provided on one end surface in circumferential direction of the free recess portion and restricting the rotation of the first rotation body relative to the second rotation body in either direction of the advance angle side and the retard angle side by being connected to the lock member, the lock recess portion provided continuously along the stopper surface and being capable of accommodating the lock member to restrict the relative rotation between the first rotation body and the second rotation body, and a biasing means always biasing the lock member towards the lock recess portion.

The effects of the technical means in the invention of the valve timing are as follows. Since the stopper mechanism and the lock mechanism including the lock member, the free recess portion, the stopper surface, the lock recess portion, and the lock spring are provided on the housing member and the rotor member, machining on the end surface in circumferential direction of the shoe portion of the housing member and on the end surface in circumferential direction of the vane portion of the rotor member is not required, and the vane portion of the rotor member and the shoe portion of the housing member are not required to have an excess strength. Accordingly, the manufacturing cost can be reduced and the size of the valve timing controller can be reduced by making thinner vane portion of the rotor member.

Since the stopper surface defining the initial phase, by the contact with the tip portion of the lock member is formed on one end in circumferential direction of the free recess portion and the lock recess portion is formed continuously along the stopper surface (since the stopper surface and the lock recess portion are formed at one place on the same member), severe tolerance of the relative position of the lock recess portion relative to the initial phase can be easily achieved. Accordingly, the productivity of the valve timing controller of the invention can be improved.

Since the tip portion of the lock member which is always projecting and a small gap will be sufficient for allowing the sliding movement between the lock member and the housing member (or rotor member) slidably supporting the lock member, the external materials rarely enter into the gap, and the entrapment of the external materials can be prevented. This improves the locking operation reliability of the lock member.

When the second stopper surface restricting the maximum relative rotational amount of the rotor member relative to the housing member is formed on the other end surface in circumferential direction of the free recess portion opposite to the stopper surface at the practical use of the invention, the maximum rotational amount of the rotor member relative to the housing member can be precisely and easily set by precisely forming the length in circumferential direction of the free recess portion.

BRIEF DESCRIPTION OF THE DRAWINGS

These and other objects and features of the invention will be more apparent and more readily appreciated from the following detailed description of the preferred embodiments of the invention with the accompanying drawings, in which.

DESCRIPTION OF THE PREFERRED EMBODIMENTS

Figure 1:
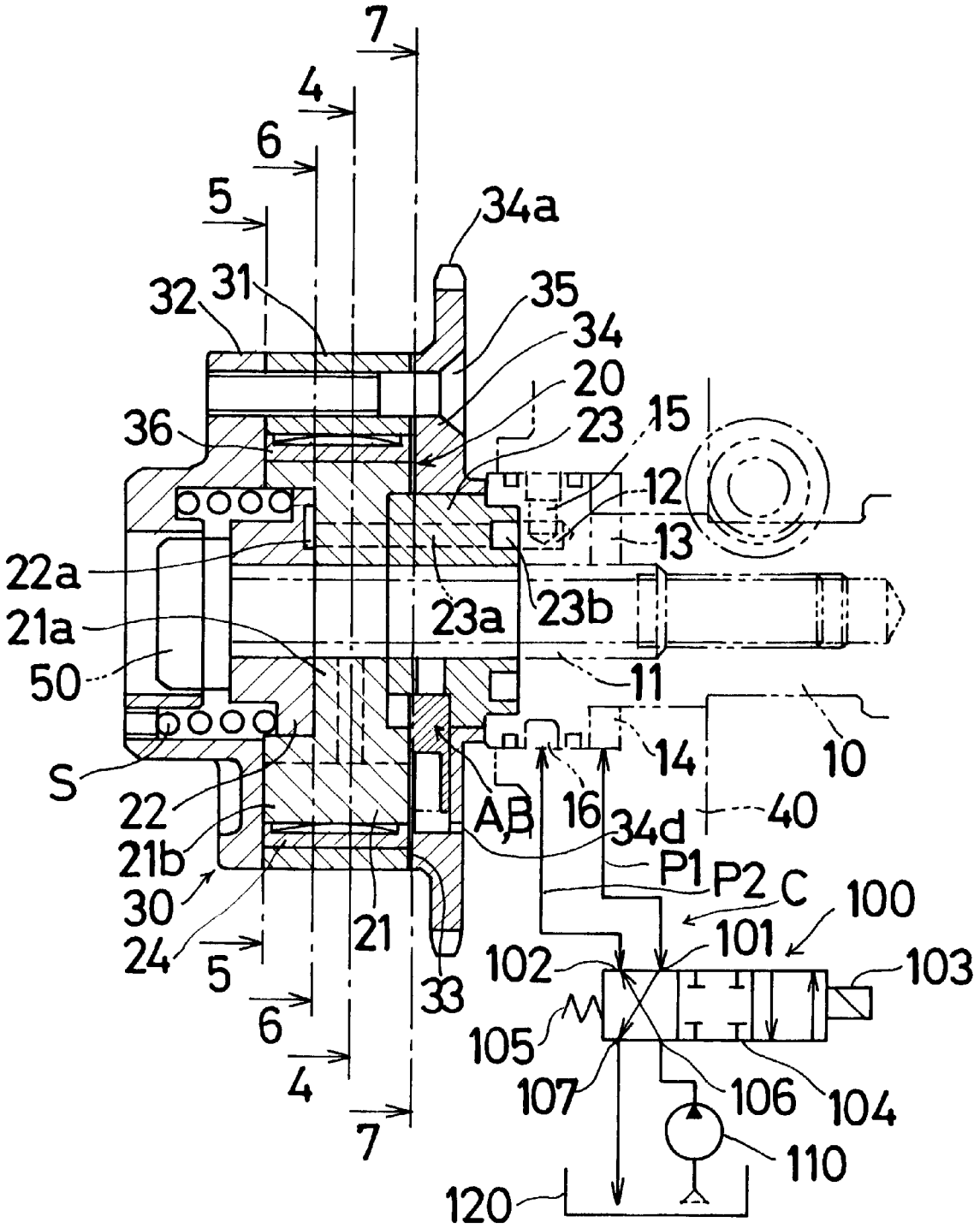
FIG. 1 is a cross-sectional view (taken on line 1—1 of FIG. 3) of an embodiment of a valve timing controller in accordance with the present invention
Figure 2:
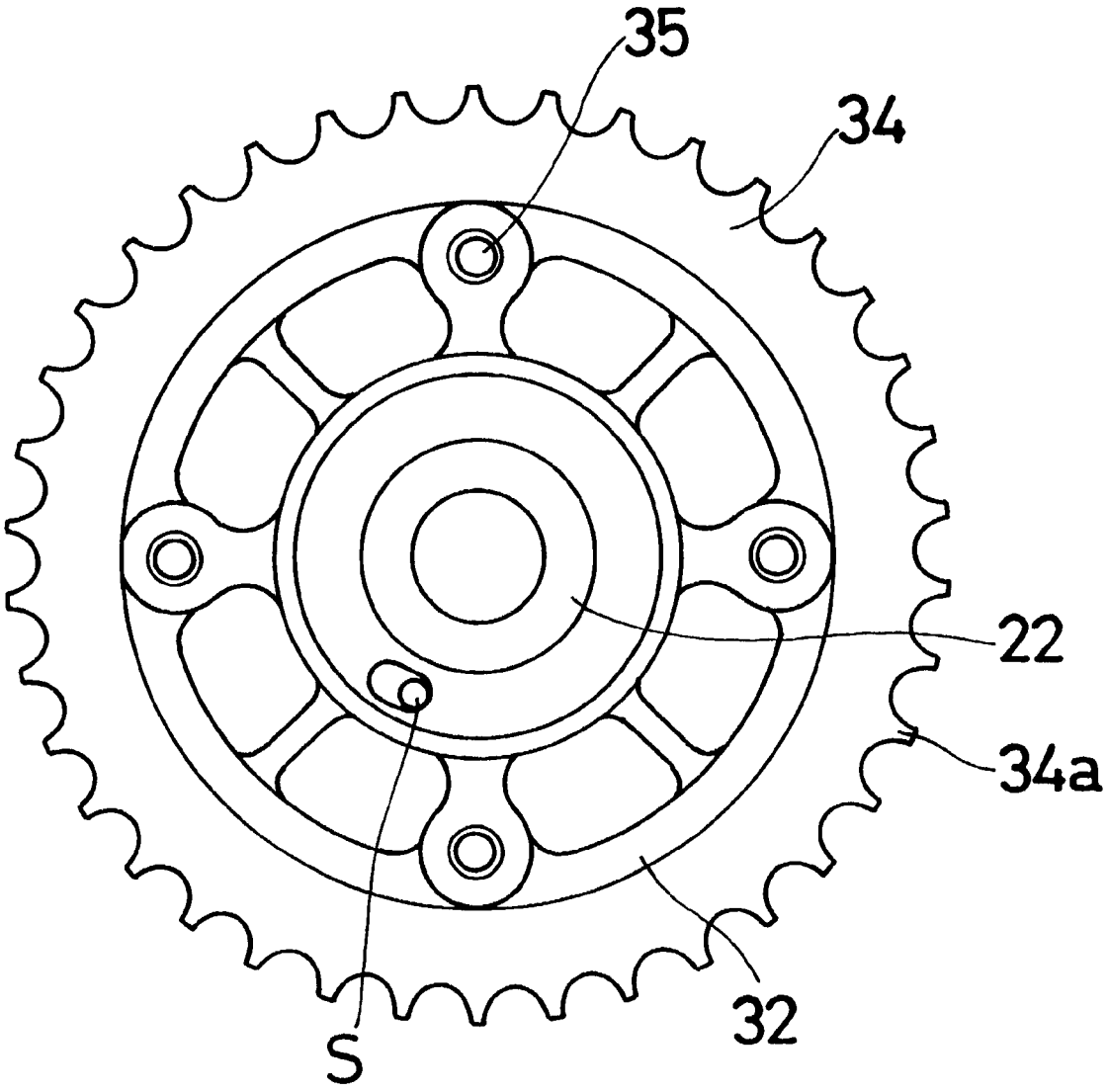
FIG. 2 is a front view of the valve timing controller shown in FIG. 1.
Figure 3:
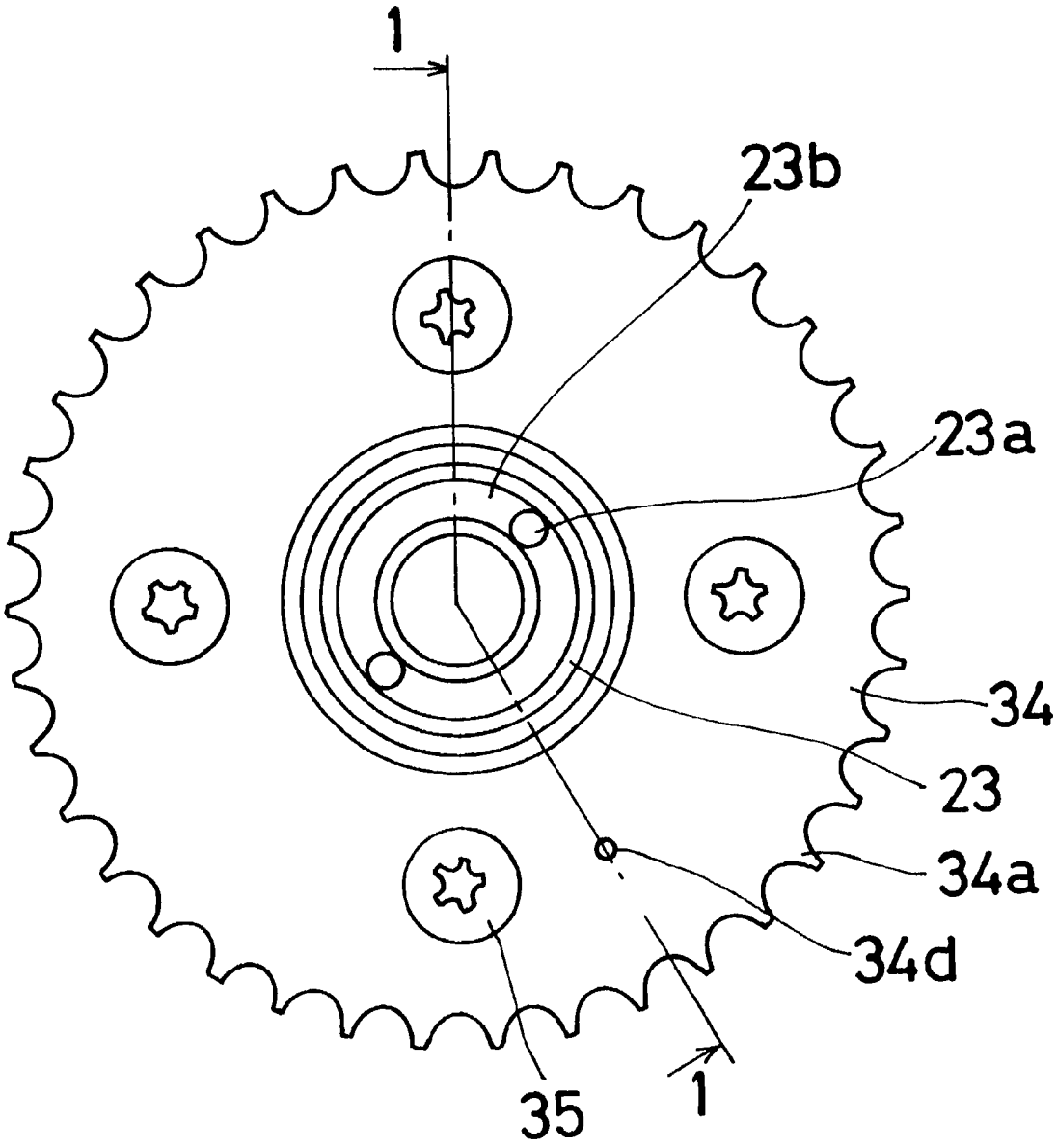
FIG. 3 is a back view of the valve timing controller shown in FIG. 1.

The preferred embodiments of a valve timing controller of the invention will be described as follows referring to FIGS. 1 through 7. The valve timing controller of the invention illustrated in FIGS. 1 through 7 includes a rotor member 20 (a first rotation body) assembled on a tip portion of a camshaft in one unit therewith, a housing member 30 (a second rotation body) outfitted with the rotor 20 for relative rotation within a predetermined range, torsion springs disposed between the housing member 30 and the rotor member 20 and always biasing the rotor member 20 to the housing member 30 in advance angle side, a stopper mechanism A regulating an initial phase (the most retarded angle position) and the most advanced angle position of the housing member 30 and the rotor member 20, a lock mechanism B restricting the relative rotation between the housing member 30 and the rotor member 20 at the initial phase, and a hydraulic circuit C controlling supply and exhaust of the operation fluid to an advance angle fluid chamber R1 and a retard angle fluid chamber R2 and controlling locking and unlocking of the lock mechanism B.

The camshaft 10 having a conventional cam mechanism which opens and closes an intake valve is rotatably supported by a cylinder head 40 of the internal combustion engine and wherein an advance angle conduit 11 and a retard angle conduit 12 extending in axial direction of the camshaft 10 are disposed therein. The advance angle conduit 11 is connected to a connecting port 101 of a switching valve 100 via a conduit 13 in radial direction, an annular conduit 14, and a connecting conduit P1. The retard angle conduit 12 is connected to a connecting port 102 of the switching valve 100 via a conduit 15 in radial direction, an annular conduit 16, and a connecting conduit P2. The conduit 13, 15 in radial direction and the annular conduit 16 are formed in the camshaft 10. The annular conduit 14 is formed between the stepped portion of the camshaft 10 and the cylinder head 40.

The switching valve 100 comprises the hydraulic circuit C with an oil pump 110 and a reservoir 120 and is capable of moving a spool 104 in left direction of FIG. 1 against a biasing force of a spring 105 by energizing a solenoid 103.

When the solenoid valve 103 is de-energized, a supply port 106 connected to the oil pump 110 actuated by the internal combustion engine is in communication with the connecting port 102 and the connecting port 101 is in communication with an exhaust port 107 connected to the reservoir 120. When a first predetermined current is applied, the supply port 106 and the exhaust port 107 are disconnected from the connecting port 101 and the connecting port 102 respectively. When a second predetermined current (larger than the first predetermined current) is applied, the supply port is in communication with the connecting port 101 and the connecting port 102 is in communication with the exhaust port 107.

Accordingly, at the de-energized condition of the solenoid 103, the operation fluid from the oil pump 110 is supplied to the retard angle conduit 12 and the operation fluid is exhausted from the advance angle conduit 11 to the reservoir 120. At the energized condition of the first predetermined current, the operation fluid is reserved in the advance angle conduit 11 and the retard angle conduit 12. At the energized condition of the second predetermined current, the operation fluid from the oil pump 110 is supplied to the advance angle conduit 11 and the operation fluid is exhausted from the retard angle conduit 12 to the reservoir 120.

The rotor member 20 is comprised of a main rotor 21, stepped cylindrical front rotor 22 assembled in one unit on the front and the back (on the left and right in FIG. 1) of the main rotor 21, and a stepped cylindrical rear rotor 23 (a connecting member and a projecting portion). The rotor member 20 is secured in one unit to the front end of the camshaft 10 with a bolt 50. Central inner holes of respective rotors 21, 22, and 23 are closed at their front ends by the head portion of the bolt 50 and in communication with the advance angle conduit 11 provided in the camshaft.

The main rotor 21 includes a hub portion 21*a* to which the front and rear rotors 22, 23 are coaxially assembled. The main rotor 21 further includes four vane portions 21*b*, four advance angle fluid conduits R1 and four retard fluid conduits R2 extending outwardly in radial direction from the hub portion 21*a* and defining therein. A sealing member 24 sealing between the advance angle fluid chamber R1 and the retard angle fluid chamber R2 is assembled on the outer end in radial direction of each vane portion 21*b*.

The hub portion 21*a* of the main rotor 21 includes four radically extended conduits 21*c* communicating with the advance angle fluid conduit R1 at the outer end in radial direction and with the advance angle conduit 11 via the central inner holes at inner end in radial direction, four conduits 21*d* extended in axial direction communicating with the retard angle conduit 12, and four radial conduits 21*e* communicating with the retard angle fluid chamber R2 at the outer end in radial direction.

Figure 4:
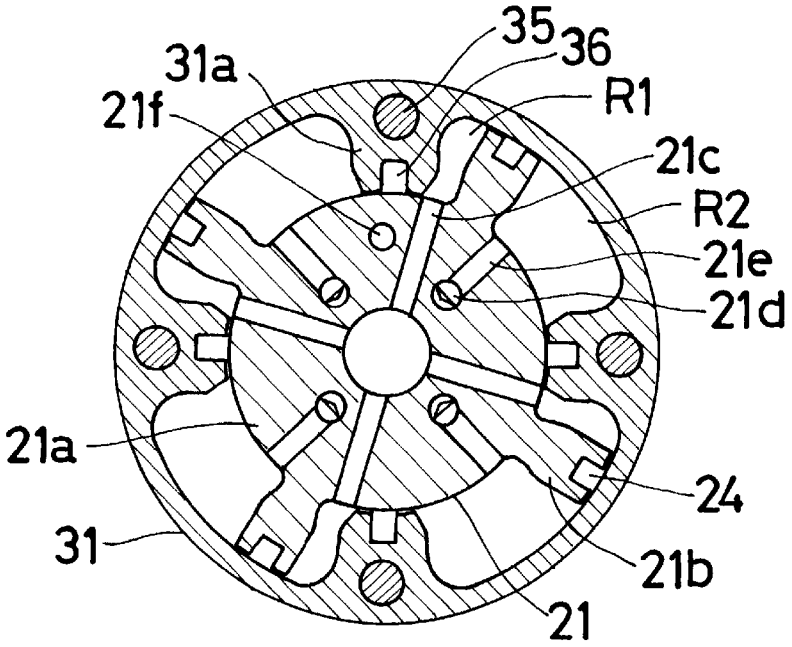
FIG. 4 is a cross-sectional view taken on line 4—4 of a sprocket shown in FIG. 1.
Figure 5:
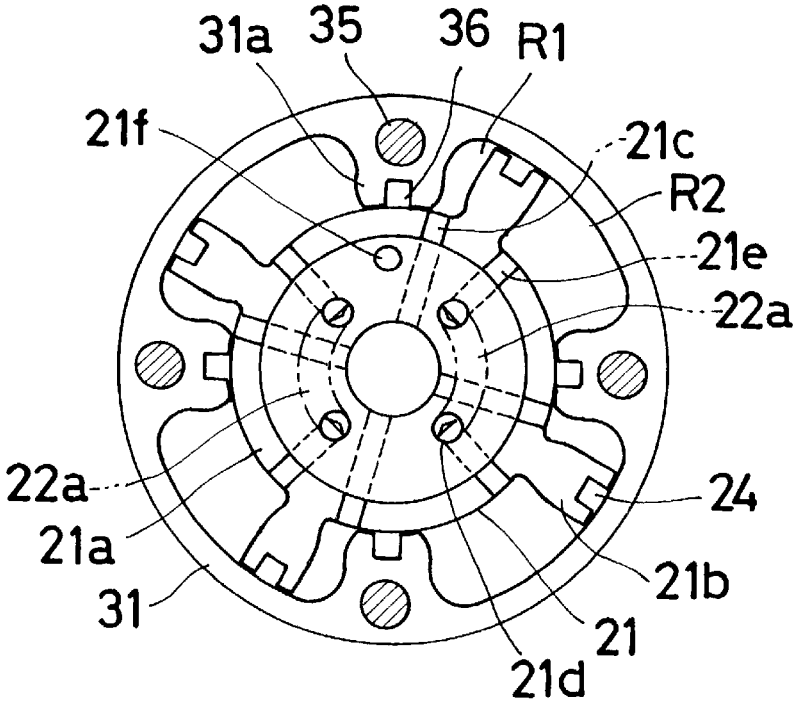
FIG. 5 is a cross-sectional view taken on line 5—5 of the sprocket and a front rotor shown in FIG. 1.
Figure 6:
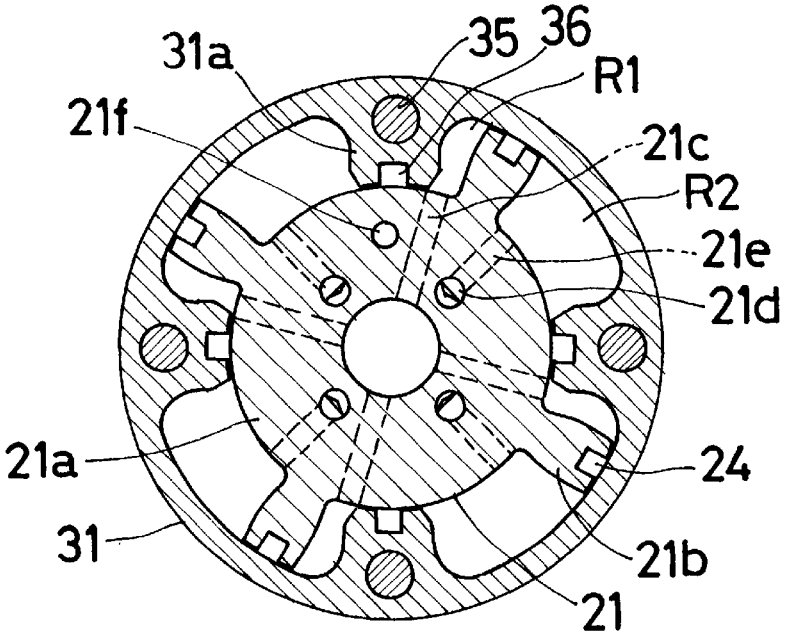
FIG. 6 is a cross-sectional view taken on line 6—6 of the sprocket shown in FIG. 1.

Two opposing conduits 21*d* extended in axial direction of the four (those shown on the top left and the bottom right in FIGS. 4 through 6) are penetrated into the main rotor 21 in axial direction, communicating with the retard angle conduit 12 via a conduit 23*a* extended in axial direction and an annular conduit 23*b* (refer to FIG. 1 and FIG. 3) disposed in the rear rotor 23. The other pair of opposing conduits 21*d* extended in axial direction (shown on the top right and the bottom left in FIGS. 4 through 6) are opening only to the front side of the main rotor 21 and are communicated with the conduits 21*d* penetrated in axial direction through a pair of arc shaped communicating grooves 22*a* (refer to FIG. 1 and FIG. 5) formed on the back of the front rotor 22. A hole 21*f* in axial direction shown in FIG. 4 through 6 is formed for inserting a pin (not shown) connecting the main rotor 21 and the front rotor 22.

The housing member 30 comprises a housing body 31, a front plate 32, a rear thin plate 33, a rear thick plate 34, and four bolts 35 connecting those components in one unit. A sprocket 34*a* is formed in one unit on a periphery of the rear thick plate 34. The sprocket 34*a* is connected to a crankshaft (not shown) of the internal combustion engine via timing chain (not shown) and is structured to transmit the driving force from the crankshaft.

The housing body 31 includes two pairs of (four) shoe portions 31*a* projecting inwardly in radial direction and supporting the hub portion 21*a* of the main rotor 21 for relative rotation via a sealing portion 36 at inner end in radial direction of each shoe portion 31*a*. The front plate 32 and the rear thin plate 33 slidably contact the outer periphery of the end surface in axial direction of the hub portion 21*a*, the entire end surface in axial direction of each vane portion 21*b*, and the entire end surface in axial direction of each sealing portion member 36.

In the housing member 30, an accommodation portion accommodating the rotor member 20 having cylindrical shape with the bottom opening in the rear direction (right direction in FIG. 1) is formed with housing body 31 and the front plate 32. A cover portion for covering the opening portion of the accommodation portion is formed with the rear thin plate 33 and the rear thick plate 34.

Figure 7:
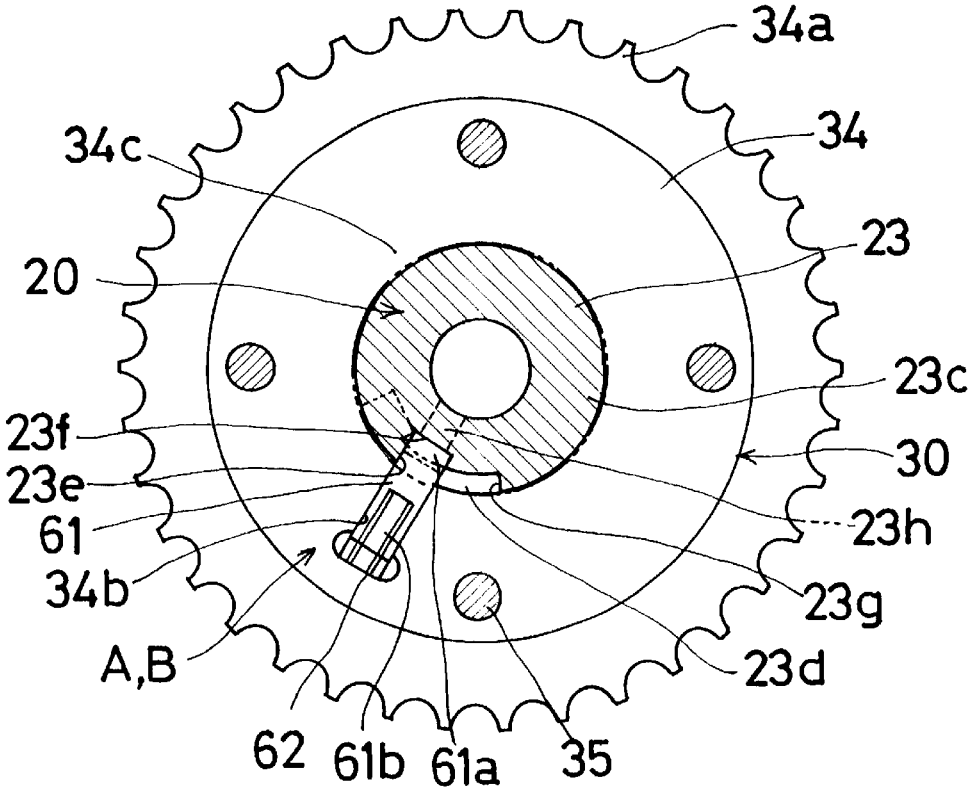
FIG. 7 is a cross-sectional view taken on line 7—7 of FIG. 1.

As shown in FIG. 1 and FIG. 7, the rear thick plate 34 (drive force transmitting means) includes an accommodation groove 34*b* in a hub portion 34*c*. The accommodation groove 34*b* is opened to the front side of the main rotor 21 and inwardly in radial direction and the opening of the front side is closed by the rear thin plate 33 (only the inner periphery brim) is illustrated with an imaginary line in FIG. 7).

The accommodation groove 34*b* is relatively rotatably supported on the periphery of the rear rotor 23 projecting from the opening portion of the housing member 30 at the inner periphery of the hub portion 34*c*. In the accommodation groove 34*b*, a lock key 61 (restricting means) and a lock spring 62 are assembled rotatably in one unit to the rear thick plate 34.

The lock key 61 formed in rectangular shape in cross section has a sufficient length such that the tip portion 61*a* protrudes from the accommodation groove 34*b* when the key 61 moves until it contacts the outer end in radial direction of the accommodation groove 34*b*, wherein the tip portion 61*a* is normally projecting towards a free recess portion 23*d* formed on the outer periphery of the hub portion 23*c* of the rear rotor 23. On the outward portion (in radial direction) of the lock key 61, a groove 61*b* accommodating a portion of a lock spring 62 is formed. The groove 61*b* is opened to front side of the main rotor 21 and outwardly in radial direction. Since the outer end in radial direction of the accommodation groove 34*b* is opened through a hole 34*d,* the swift move of the lock key 61 in radial direction is ensured.

The arc shaped free recess portion 23*d* extending in the circumferential direction accommodates the tip portion 61*a* of the lock key 61 while allowing the relative rotation of the housing member 30 and the rotor member 20. A stopper surface 23*e* defining the initial phase (most retarded angle position) by the contact of the lock key 61 and the tip portion 61*a* is formed in circumferential direction on one end of the free recess portion 23*d.* A lock recess portion 23*f* is formed continuously along the stopper surface 23*e.*

The lock spring 62 always biases the lock key 61 towards the bottom of the free recess portion 23*d,* i.e., the radically inward direction of the rear thick plate 34. Accordingly, the lock key 61 is slidable in the direction of the accommodation in the free recess portion 23*d* (the radial direction of the rear thick plate 34) at the rear thick plate 34.

As shown in FIG. 7 the lock recess 23*f* is capable of accommodating the tip portion 61*a* of the lock key 61 to be locked therein along the circumferential direction at the initial phase. A hole 23*h* extended in radial direction and communicating with the advance angle conduit 11 at the inner end in radial direction is opened on the bottom portion of the lock recess portion 23*f.* When the operation fluid is supplied from the advance angle conduit 11 via a hole 23*h,* the lock key 61 is moved to the position shown with the imaginary line of FIG. 7 against the biasing force of the lock spring 62 outwardly in radial direction. When the operation fluid is exhausted to the advance angle conduit 11 via the hole 23*h,* the lock key 61 is moved to the lock recess 23*f* by the biasing of the lock spring 62, the tip portion 61*a* of the lock key 61 is engaged with the lock recess 23*f* and accommodated.

In one embodiment with above-mentioned structure, as shown in FIG. 7, the lock key 61 is engaged with the lock recess portion 23*f* by the biasing force of the lock spring 62 and is accommodated when the operation fluid is not supplied to the advance angle conduit 11 and the retard angle conduit 12 from the oil pump 110 actuated by the starting of the internal combustion engine via the switching valve 100.

Accordingly, even if the positive and negative reverse torque is generated in the camshaft 10 when actuating the intake valve, since the lock key 61 restricts the relative rotation of the rotor member 20 to the housing member 30, relative rotational vibration is not generated and the noise generated accompanied with the rotational vibration is prevented. When the switching valve 100 is under de-energized condition as shown in FIG. 1 at the starting of the internal combustion engine, the operation fluid is supplied from the oil pump 110 to the retard angle conduit 12 via the switching valve 100, and at the point when the operation fluid is introduced to the retard angle fluid chamber R2, the relative rotation of the rotor member 20 and the housing member 30 is regulated by the hydraulic pressure in the retard angle fluid chamber R2 as well.

When the solenoid 103 of the switching valve 100 is switched from de-energized condition to energized condition of a second predetermined current, the supply port 106 communicates with the connecting port 101, the connecting port 102 communicates with the exhaust port 107, the operation fluid is supplied to the advance angle conduit 11, and the operation fluid is discharged from the retard angle conduit 12 to the reservoir 120. Accordingly, the operation fluid is supplied to the lock recess portion 23*f* from the advance angle conduit 11 through the hole 23*h* of the rear rotor 23, the operation fluid is supplied to the advance angle fluid chamber R1 from the advance angle conduit 11 via the conduit 21*c* of the main rotor 21, and the operation fluid is exhausted from the retard angle fluid chamber R2 to the retard angle conduit 12 via the conduit 21*e* and the conduit 21*d* of the main rotor 21.

In consequence, the lock key 61 is moved clockwise from the position with actual line to the position with the imaginary line of FIG. 7 against the biasing force of the lock spring 62 by the operation fluid supplied to the lock recess portion 23*f.* The rotor member 20 is moved clockwise in FIG. 4 by the operation fluid supplied to the advance angle fluid chamber RI and rotates from the most retarded angle position to the advance angle side relative to the housing member 30. The relative rotation between the rotor member 20 and the housing member 30 is possible until the second stopper surface 23*g* formed on the rear rotor 23 and the tip portion 61*a* of the lock key 61 make a contact.

When the solenoid 103 of the switching valve 100 is switched from energized condition of the second predetermined current to energized condition of the first predetermined current, the fluid communication between the supply port 106, exhaust port 107 and each connecting port 101, 102 is blocked respectively and the operation fluid is reserved in the advance angle conduit 11 and the retard angle conduit 12. Via the reserve of the operation fluid in the advance angle conduit 11 and the retard angle conduit 12 (also recognized as the condition that the operation fluid is reserved in the advance angle fluid chamber R1 and the retard angle fluid chamber R2), the relative rotation of the rotor member 20 to the housing member 30 is regulated.

When the solenoid 103 of the switching valve 100 is switched from energized condition of the first predetermined current to de-energized condition, the supply port 106 communicates with the connecting port 102, the connecting port 141 communicates with the exhaust port 107, the operation fluid is supplied to the retard angle conduit 12, and the operation fluid is exhausted from the advance angle conduit 11 to the oil reservoir 120. Consequently, the operation fluid is supplied from the retard angle conduit 12 the retard angle fluid chamber R2 through the conduit 21*d* and the conduit 21*e* of the main rotor 21 and the operation fluid is discharged from the advance angle fluid chamber R1 to the advance angle conduit 11 through the conduit 21*c* of the main rotor.

Accordingly, the rotor member 20 is moved in counterclockwise direction of FIG. 4 by the operation fluid supplied to the retard angle fluid chamber R2 to relatively rotate in the retard angle direction relative to the housing member 30. The relative rotation of the rotor member 20 to the housing member 30 is possible until the tip portion 61 a contacts the stopper surface 23*e.* In this case, since the operation fluid can be exhausted from the lock recess portion 23*f* to the advance angle conduit 11, when the rotor member 20 rotates relative to the housing member 30, until reaching the most retarded angle position (where the stopper surface 23*e* formed on the rear rotor 23 and the tip portion 61*a* of the lock key 61 contact) after the lock key 61 has been moved by the biasing force of the lock spring 62 and the tip portion 61 has engaged with the lock recess portion 23*f* to be accommodated.

Apparent from the explanation above, in this embodiment of the invention, the position of the relative rotation of the rotor member 20 to the hosing member 30 is freely adjustable in the range from the most retarded angle position to the most advance angle position by controlling the energized condition to the solenoid 103 of the switching valve 100 and the timing for opening and closing the valve when actuating the internal combustion engine is properly adjustable. When the internal combustion engine is stopped, the energized condition to the solenoid 103 is controlled so that the tip portion 61*a* of the lock key 61*b* is engaged with the rock recess portion 23*f* and accommodated.

In another embodiment of the invention, a phase controlling means is structured with the hydraulic pressure circuit C, the advance angle fluid chamber R1 and the retard angle fluid chamber R2 formed between the housing member 30 and the rotor member 20, the hydraulic pressure conduit communicating with the advance angle fluid chamber R1, the retard angle fluid chamber R2, and the hydraulic pressure circuit C, and the vanes 21*b* formed in the rotor member 20 and receiving the pressure from the advance angle fluid chamber R1 and the retard angle fluid chamber R2.

In another embodiment of the invention, the stopper mechanism A and the stopper mechanism B are disposed on each hub portion of the housing member 30 and the rotor member 20. The stopper mechanism A includes the lock key 61, the free recess portion 23*d,* the stopper surface 23*e,* 23*g*. The stopper mechanism B includes the lock key 61, the rock recess portion 23*f,* and the lock spring 62.

Sharing the lock key 61 between the stopper mechanism A and the stopper mechanism B enables to structure the stopper mechanism A and the stopper mechanism B in one unit, which, consequently, reduces the size of the device. In particular, the sharing eliminates the need for machining on the end surface in circumferential direction of the shoe portion 31*a* of the housing member 30 and on the end surface in circumferential direction of the vane portion 21*b* of the rotor member 20. As such, the strength of the vane portion 21*b* and the shoe portion 31*a* is not strictly required so that they can be made thin, which reduces the manufacturing cost and size of the device.

Since the stopper surface 23*e* regulating the initial phase (by the contact with the tip portion 61*a* of the lock key 61) is formed on one end in circumferential direction of the free recess portion 23*d* and the lock recess portion 23*f* is formed continuously along the stopper surface 23*e* (since the stopper surface 23*e* and the lock recess portion 23*f* are formed on the same position of the rear rotor 23), strict tolerance of the relative position of the lock recess portion 23*f* at the initial phase can be easily obtained. Accordingly, the efficiency of the device is improved.

The tip portion 61*a* of the lock key 61 is normally projecting as shown with the actual line and the imaginary line in FIG. 7. A small gap for allowing the sliding can be provided between the lock key 61 and the housing member 30 (rear thin plate 33 and the rear thick plate 34) slidably supporting thereof. Since external materials rarely enter this gap and the entrapment of the external materials can be prevented, the operation reliability of the lock key 61 can be improved.

Since the second stopper surface 23*g* regulating the maximum relative rotational amount of the rotor member 20 to the housing member 30 is formed on the other end in circumferential direction of the free recess portion 23*d* opposite to the stopper surface 23*e,* the maximum relative rotational amount of the rotor member 20 to the housing member 30 is easily set by forming the precise length in peripheral direction of the free recess portion 23*d*.

Since the maximum relative rotational amount can be set by changing the length in peripheral direction of the free recess portion 23*d* disposed on the rear rotor 23, the valve timing control device adapted to various models of vehicles can be produced by changing the rear rotor 23 and the other parts (the components for the rotor member 20 except the rear rotor 23 and the components for the housing member 30) can be platformed.

The conventional valve timing controller, as shown in the aforementioned prior art Japan Patent Laid-open Publication H09-60508, has a lock mechanism structured with a piston slidably disposed in the accommodation hole on the vane portion, tapered hole formed on a housing member connected to the piston, and a spring biasing the piston towards the tapered hole. In other word, the conventional lock mechanism is disposed in the accommodation portion of the housing. The vane portion disposed with a piston in the conventional valve timing controller is required to be formed wider in peripheral direction than the vane portion without the piston as in the invention. Accordingly, the rotor member is imbalanced. In addition, since the tapered hole is formed on the housing member, the housing member is also imbalance. The imbalance of the rotor member and the housing impedes the smooth and swift rotation of the rotor member and the housing member, which consequentially impedes the phase control of the valve timing controller.

For dissolving above mentioned imbalance, for example, the imbalance at the vane portion, it is considered to balance with symmetrical vane portion at the rotation axis. Changes of the structure, such as adding the mass on the symmetrical vane portion, which generates the increase of the mass of the device and the restriction of maximum angle of the phase change, achieves such a balancing.

On the other hand, in the valve timing controller of this embodiment of the invention, the lock mechanism is disposed outside of the accommodation portion of the housing member 30, that is in the rear thick plate 34 and the rear rotor 23. In this structure, although the imbalance is generated between the rear thick plate 34 and the rear rotor 23, the imbalance is solved by machining the rear plate 34 and the rear rotor 23 which is thinner than the vane portion. Since the parts symmetrical to the rotation axis of the part disposed with the lock key 62 exists on the rear thick plate 34 and the rear rotor 23, the balance is easily achieved by machining such symmetrical parts. This improves the efficiency of the machining compared to the one with conventional structure. In this structure, the balancing is not restricted by the provided number of the vane portion 21*b*.

In another embodiment of the invention, the valve timing controller being capable of solving the rotation imbalance easier than the conventional valve timing controller is provided. This valve timing controller includes the rotor provided in one unit with the camshaft opening or closing at least one of the intake valve or the exhaust valve of the internal combustion engine, the housing rotatably and coaxially disposed relative to the rotor and transmitting the driving force of the drive shaft to the rotor by being rotated in one unit with the drive shaft of the internal combustion engine, the phase change controlling means changing the phase of the rotor from the advance angle side to the retard angle side relative to the housing. The housing includes the accommodation portion with cylindrical shape with the bottom accommodating the rotor, the cover portion covering the opening of the accommodation portion, and the lock mechanism a portion of the structure thereof is disposed outside of the accommodation portion and regulating the relative rotation between the rotor and the housing. In this case, the cover portion is flat plate shaped and at least part of the lock mechanism is formed in the cover portion. The rotor includes the projecting portion projecting from the opening. The lock mechanism includes the restricting means regulating the relative rotation between the rotor and the housing by being connected to the cover portion and the projecting portion.

The aforementioned conventional valve timing controller includes a rotor in one unit with the camshaft opening and closing one of the intake valve and the exhaust valve of the internal combustion engine, a timing sprocket rotating in one unit with the drive shaft of the internal combustion engine and transmitting the driving force from the drive shaft to the rotor, and the phase controlling means changing the phase of the rotor to the advance angle side or to the retard angle side relative to the timing sprocket. The timing sprocket is rotatably supported by the camshaft.

Generally, the shape of the camshaft depends on the model of an automobile provided with the device. Accordingly, in conventional valve timing controller, the different timing sprocket is required to be formed for different models, which impedes the production efficiency of the device.

However, in this embodiment of the invention, since the rear thick plate 34 is rotatably supported by the rear rotor 23, only the rear rotor 23 is required to be changed even when applying the valve timing controller to vehicle models with camshafts of different shapes. Since the rear rotor is easily formed compared to the rear thick plate 34, the production efficiency of the device is improved. This valve timing controller of the invention includes the rotor disposed in one unit with the camshaft rotating in an intake valve or an exhaust valve of an internal combustion engine, the driving force transmitting means rotating in one unit with the drive shaft of the internal combustion engine and transmitting the driving force of the drive shaft to the rotor, the phase change controlling means changing phase of the rotor to the advance angle side or to the retard angle side relative to the driving force transmitting means, and the connecting member provided between the rotor and the camshaft, rotatably supporting the driving force transmitting means and connecting the rotor and the camshaft.

Besides being applied to the camshaft 100 for opening and closing the intake valve of the internal combustion engine, the valve timing controller of the invention may be applied to the camshaft for opening and closing the exhaust valve of the internal combustion engine by setting the advance angle side and the retard angle side in reverse positions.

Besides the lock key 61 assembled on the housing member 30 side in this embodiment of the invention, other lock members, such as lock pin, can be assembled instead of the lock key 61 and the lock member can be assembled on the rotor member 20 side.

The structure in which the lock member (lock key 61) locks and unlocks by sliding in radial direction is adopted in this embodiment of the invention may be adapted into sliding in axial direction (in this case, it is necessary to dispose the lock recess portion, accommodating the tip portion of the lock member not to move in peripheral direction at initial phase, in axial direction).

The rotor member 20 may be assembled to the crankshaft side rather than the camshaft 10 side, then the housing member 30 is assembled to the camshaft side rather then the crankshaft side in this embodiment of the invention.

The structure of this embodiment of the invention is limited to connecting via the lock key 61 the rear thick plate 34 of the housing member 30 and the rear rotor 23 of the rotor member 20 in the stopper mechanism A and the lock mechanism B. For example, identical effect can be reached by connecting via the lock key 61 the housing member 30 and the camshaft 10.

It is intended that the foregoing detailed description be regarded as illustrative rather than limiting and that it is understood that the following claims including all equivalents are intended to define the scope of the invention.

What is claimed is:

1. A valve timing controller provided on a driving force transmitting system transmitting a driving force to a driven shaft, for opening and closing either an intake valve or an exhaust valve from the drive shaft of an internal combustion engine, comprising:

a housing member rotatable in one unit with the drive shaft or the driven shaft;

a rotor member provided for relative rotation with a pair of shoe portions provided in the housing member, forming an advance angle fluid chamber and a retard angle fluid chamber in the housing member with a vane portion;

a stopper mechanism for defining a initial phase of the housing member and the rotor member;

a lock mechanism disposed in the housing member and the rotor member for restricting the relative rotation of the housing member and the rotor member at the initial phase;

a hydraulic pressure circuit for controlling the supply and the exhaust of an operation fluid to the advance angle fluid chamber and the retard angle fluid chamber and controlling lock/unlock of the lock mechanism;

a lock member slidably assembled with the housing member or the rotor member and a tip portion of said lock member which is always projecting towards the rotor member or the housing member and which moves in a radial direction of the housing member or the rotor member;

a free recess portion formed in the rotor member or in the housing member for accommodating a tip portion of the lock member while allowing the relative rotation of the housing member and the rotor member;

a stopper surface formed on one end surface in the circumferential direction of the free recess portion for defining the initial phase by the contact with the tip portion of the lock member;

a lock recess portion formed continuously along the stopper surface and being capable of accommodating the tip portion of the lock member by restricting the movement thereof in circumferential direction at the initial phase; and a lock spring for biasing the lock member towards the lock recess portion.

2. A valve timing controller according to claim 1, wherein a second stopper surface for regulating the maximum rotation amount of the rotor member relative to the housing member is formed on the other end in circumferential direction of the free recess portion opposite to the stopper surface.

3. A valve timing controller comprising:

a first rotation body for opening and closing at least one of an intake valve and an exhaust valve of an internal combustion engine;

a second rotation body for rotating in one unit with a drive shaft of an internal combustion engine and transmitting a driving force from the drive shaft to the first rotation body; and a phase change controlling means for changing the phase of the fist rotation body to an advance angle side or to a retard angle side relative to the second rotation body, including:

a stopper mechanism for regulating a rotational amount of the first rotation body to the second rotation body at least to either the advance angle side or the retard angle side; and a lock mechanism for restricting the relative rotation between the first rotation body and the second rotation body, the lock mechanism being operatively positioned in the first and second rotation bodies, wherein the first rotation body and the second rotation body are coaxially arranged and the lock mechanism includes a lock member disposed slidably and rotatably in one unit with one of the first rotation body and the second rotation body and which moves in a radial direction of the first rotation body or the second rotation body;

a free recess portion provided on the other one of the first rotation body and the second rotation body for accommodating the lock member while allowing the relative rotation of the first rotation body and the second rotation body;

a stopper surface provided on one end surface in peripheral direction of the five recess portion for restricting the rotation of the first rotation body relative to the second rotation body to either the advance angle side or the retard angle side by being connected to the lock member;

a lock recess portion provided continuously along the stopper surface for restricting the relative rotation of the first rotation body and the second rotation body; and a biasing means for biasing the lock member towards the lock recess portion.

* * * * *